US007284468B2

(12) United States Patent
Supe-Dienes et al.

(10) Patent No.: US 7,284,468 B2
(45) Date of Patent: Oct. 23, 2007

(54) BLADE HOLDER HAVING DISPLACEMENT-DEPENDENT SPRING FORCE COMPENSATION

(75) Inventors: Rudolf Supe-Dienes, Overath (DE); Falk Oberhoff, Reichshof (DE)

(73) Assignee: Dienes Werke für Maschinenteile GmbH & Co. KG (DE)

( * ) Notice: Subject to any disclaimer, the term of this patent is extended or adjusted under 35 U.S.C. 154(b) by 293 days.

(21) Appl. No.: 10/741,163

(22) Filed: Dec. 18, 2003

(65) Prior Publication Data

US 2004/0211070 A1 Oct. 28, 2004

(30) Foreign Application Priority Data

Dec. 19, 2002 (DE) ..... 102 60 031

(51) Int. Cl.
*B26D 1/15* (2006.01)

(52) U.S. Cl. ..... 83/502; 91/508

(58) Field of Classification Search ..... 83/499, 83/501, 502, 504, 425.4; 91/162, 508
See application file for complete search history.

(56) References Cited

U.S. PATENT DOCUMENTS 3,819,021 A * 6/1974 Schacher et al. ..... 192/111.12
3,892,156 A * 7/1975 Johnstone ..... 83/469
4,905,554 A * 3/1990 Cavagna ..... 83/482
5,247,865 A * 9/1993 Kroger et al. ..... 83/482

FOREIGN PATENT DOCUMENTS

DE 41 14 059 11/1992

* cited by examiner

*Primary Examiner*—Kenneth E. Peterson
(74) *Attorney, Agent, or Firm*—Robert W. Becker & Associates; Robert W. Becker

(57) ABSTRACT

A blade holder for cutting machines includes a blade head held on a raising and lowering device and an adjustment mechanism for a circular blade that is held on the blade head. The adjustment mechanism, for the movement of the circular blade between a cutting position and a ready position, is provided with an adjustment piston rod having an adjustment piston that is guided in a chamber of the blade head housing and can be moved by compressed air. The adjustment piston rod is biased by a compression spring into the ready position of the circular blade. The piston surface of the adjustment piston has a cross-sectional area that is configured such that as the path of the adjustment piston in the direction of adjustment increases, the piston surface that is acted upon by compressed air increases.

9 Claims, 3 Drawing Sheets

BLADE HOLDER HAVING DISPLACEMENT-DEPENDENT SPRING FORCE COMPENSATION

BACKGROUND OF THE INVENTION

The invention relates to a blade holder for cutting machines, with a blade head held on a raising and lowering device, and with an adjustment mechanism for a circular blade that is held on the blade head, whereby for the movement of the circular blade between a cutting position and a ready position, the adjustment mechanism is provided with an adjustment piston rod having a compressed air activated adjustment piston that is guided in a chamber of the blade head housing, and the adjustment piston rod is biased via a compression spring into the ready position of the circular blade.

A blade holder having the aforementioned features is described in DE 4114 059 A1; the blade head that caries the circular blade is seated at the end of a lowering piston rod via which the circular blade can be lowered into its cutting plane and raised therefrom. The adjustment mechanism disposed in the blade head serves for an adjustment of the circular blade transverse to the axis of the lowering piston rod until it rests against a lower blade, or raises the circular blade from the lower blade beyond the cutting process.

To carry out these movement processes, the adjustment mechanism has an adjustment piston that is compressed air actuatable in a direction of the cutting position of the circular blade, while for the return movement of the circular blade out of the cutting position, there is provided a compression spring that acts upon the adjustment piston rod and biases it into the ready position of the circular blade. Thus, in addition to the pressing force in a direction of the cutting position of the circular blade, which pressing force overcomes the biasing compression spring and is applied by the compressed air supply to the adjustment piston, there is also provided the cutting force that exists between the circular blade and an associated lower blade.

Since over the adjustment path of the adjustment mechanism, depending upon the position of the blade holder on the cutting machine, different cutting positions with the circular blade resting upon the lower blade can result, the known construction of a blade holder has the drawback that at respectively the same air driving pressure, in different cutting positions different cutting forces are also established, because a respective spring force of the biasing compression spring, which spring force varies in magnitude as a function of the spring characteristics or of spring tolerances, counteracts the air driving pressure in the various cutting positions.

It is therefore an object of the invention, with a blade holder of the aforementioned type and with an unaltered air driving pressure over the adjustment path, to establish for the adjustment mechanism a cutting force that remains as constant as possible in different cutting positions of the circular blade.

SUMMARY OF THE INVENTION

The basic concept of the invention is that the piston surface of the adjustment piston that is effective in the direction of adjustment has a cross-sectional area that is different in different positions of the piston such that as the path of the adjustment piston in the direction of adjustment increases, the piston surface that is acted upon by the compressed air increases.

The invention has the advantage that, with the spring force, which increases at the end of the adjustment path due to the generally progressive spring characteristic, and which spring force must be overcome by the adjustment piston, an increase of the piston force results due to the increase of the piston surface, while the air driving pressure remains the same, so that the spring force, which becomes greater as the adjustment path advances, is compensated for hereby, and in the different cutting positions defined by the respective piston position a respectively approximately uniform cutting force results.

Pursuant to one embodiment of the invention, it is provided that the piston surface of the adjustment piston be increased in a stepless or continuous manner.

In detail, it can for this purpose be provided that the piston surface of the adjustment piston that is acted upon by the compressed air be formed by a membrane that is secured to the outer wall of the chamber, and that in the direction of adjustment, the outer wall of the chamber widen conically in a continuous manner such that as the path of the adjustment piston in the direction of adjustment increases, the membrane rolls off on the widening outer wall, as a result of which the membrane surface, which is effective as the piston surface, increases in a continuous manner. In this connection, it can be expedient for the adjustment piston to be disposed in the chamber accompanied by the formation of an annular space that is bridged by the membrane that spans the end face of the adjustment piston, and for the membrane to extend into the annular space with a loop that enables the movement of the adjustment piston in the chamber. For such an arrangement it is proposed that the compressed air supply into the chamber be disposed in the region of the end face of the adjustment piston.

Alternatively, it can be provided that the piston surface be increased in a stepwise manner.

Pursuant to a first embodiment herefor, the invention provides that the chamber be provided with a portion that when viewed in the direction of adjustment of the adjustment piston is disposed behind the compressed air supply and that has a smaller diameter formed by the formation of a step, into which portion the adjustment piston engages via an extension. Alternatively, instead of the additional chamber portion it can be provided that the adjustment piston be provided with at least one extension that, counter to the direction of adjustment, engages axially into a recess formed in the rearward wall of the chamber, and the compressed air supply is disposed in that region of the wall of the chamber disposed beyond the recess.

A two-stage method of operation of the adjustment mechanism is connected with such a configuration of the piston to the extent that initially the effective piston surface leaves out the surface of the extension, because the extension, which still lies in the portion of the chamber having the smaller diameter or in the recess of the chamber wall, is not acted upon by the air driving pressure; only after the adjustment piston has traveled a certain path, and the extension has moved out of the chamber portion or the recess in the chamber wall, is the full amount of the piston surface effective, so that a corresponding increase of the piston force is established.

It is therefore proposed pursuant to an embodiment of the invention that the axial dimension of the extension be fixed as a function of the biasing force of the compression spring.

As a further development of the two-stage manner of operation, it can be provided, pursuant to further embodiments of the invention, that the adjustment piston be provided with two extensions, having a different axial dimension, that engage into the portion of the chamber, whereby in detail it is proposed that the portion of the chamber be divided by a partition into two partial chambers that are interconnected via a passage that is covered by that extension that is the first one to be effective for increasing the piston surface, and that after a prescribed piston stroke has been achieved is released or exposed such that subsequently the second extension is additionally acted upon in the further partial chamber. Alternatively, the adjustment piston can be provided with a plurality of extensions that are distributed over its piston surface, respectively have a different axial dimension, and engage into associated recesses of the wall of the chamber. With such a configuration, any desired number of stepped increases of the piston force can be established depending upon requirements.

BRIEF DESCRIPTION OF THE DRAWINGS

Embodiments of the invention are provided in the drawings, which will be described subsequently and in which.

DESCRIPTION OF SPECIFIC EMBODIMENTS

Figure 1:
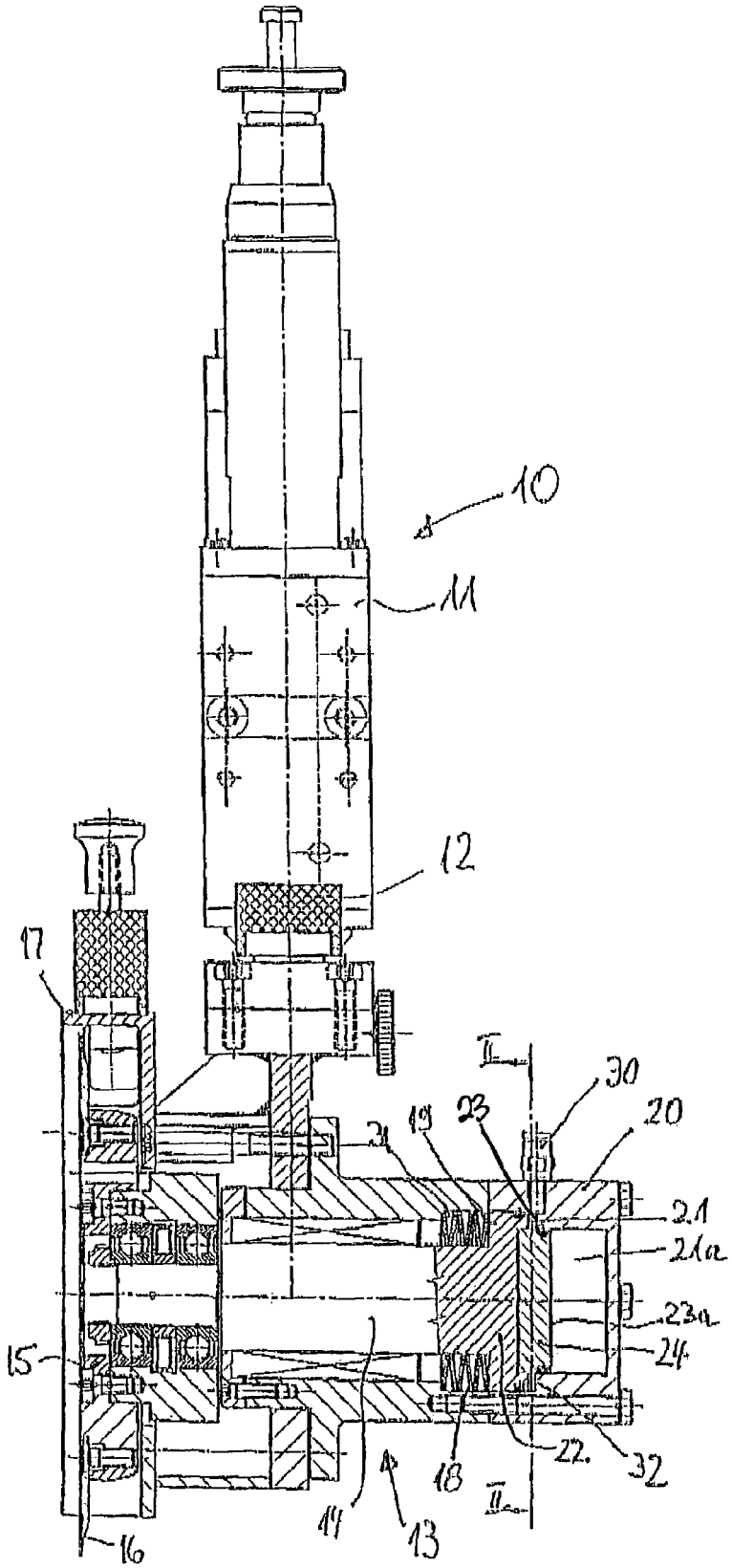
FIG. 1 shows in a longitudinal section a blade holder having an adjustment mechanism.

With the blade holder 10 shown in FIG. 1, disposed at the end of a lowering piston rod 12 having a raising and lowering device 11, which is not part of the subject matter of this invention and furthermore belongs to the state of the art pursuant to DE 38 41 576 C1, is a cutter or blade head 13 in which an adjustment piston rod 14 is displaceably disposed transverse to the axis of the lowering piston rod 12. Mounted on the associated end of the adjustment piston rod 14 is a blade carrier 15 on which is held a circular blade 16. In the ready position of the circular blade 16 illustrated in the drawing, the circular blade is surrounded by a hand guard 17.

As not further illustrated, by shifting the adjustment piston rod 14 to the left in the illustrated drawing, the circular blade 16 can be brought into a non-illustrated cutting position in which it cooperates with a similarly not-illustrated lower blade.

To carry out this adjustment movement, disposed in the blade head housing 20 is a chamber 21 having an air connection 30. The adjustment piston rod 14 extends through the chamber 21, and disposed on the adjustment piston rod 14 is an adjustment piston 22, the outer periphery of which rests sealingly against the pertaining housing wall of the chamber 21 in the blade head housing 20. In the direction toward the blade carrier 15, adjacent to the chamber 21, the blade head housing 20 has a recessed area 31 in which is dispose a compression spring 18 that on the one hand is supported against the blade head housing 20 and on the other hand is supported against a shoulder 19 formed on the adjustment piston rod 14, and thereby biases the adjustment piston rod 14 into the ready position of the circular blade 16 illustrated in FIG. 1.

Figure 2:
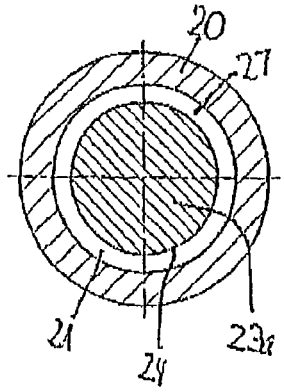
FIG. 2 shows in a cross-sectional view the adjustment mechanism of FIG. 1 taken along the line II-II in FIG. 1.

With the embodiment illustrated in FIGS. 1 and 2, the adjustment piston 22 has an extension 24 that projects axially counter to the adjustment direction and that in the starting position of the adjustment mechanism illustrated in FIG. 1 engages or extends into a portion 21*a* of the chamber 21 that is disposed behind the compressed air supply 30 when viewed in the adjustment direction of the adjustment piston 22, wherein the portion 21*a* has a smaller diameter formed by the formation of a step 32 of the chamber wall. In this way, the piston surface 23, which in this position is effectively accessible to the air pressure applied via the air connection 30, is limited to the annular surface between the periphery of the extension 24 and the outer periphery of the adjustment piston 22. To the extent that compressed air is introduced into the annular space 27 via the air connection 30, this compressed air acts only upon the annular piston surface 23 for moving the adjustment piston 22 counter to the force of the compression spring 18. Only after the extension 24 has moved out of the portion 21*a* of the chamber 21 by passing through the prescribed adjustment path does the piston surface 23*a*, which is associated with the extension 24, also come under the effect of the air pressure, so that due to the increase of the piston surface connected therewith, an increase of the piston force of the adjustment piston 22 results upon the entire surface 23, 23*a*. This increase in force then counteracts the force of the compression spring 18 that is increased over the path of the piston.

Figure 3:
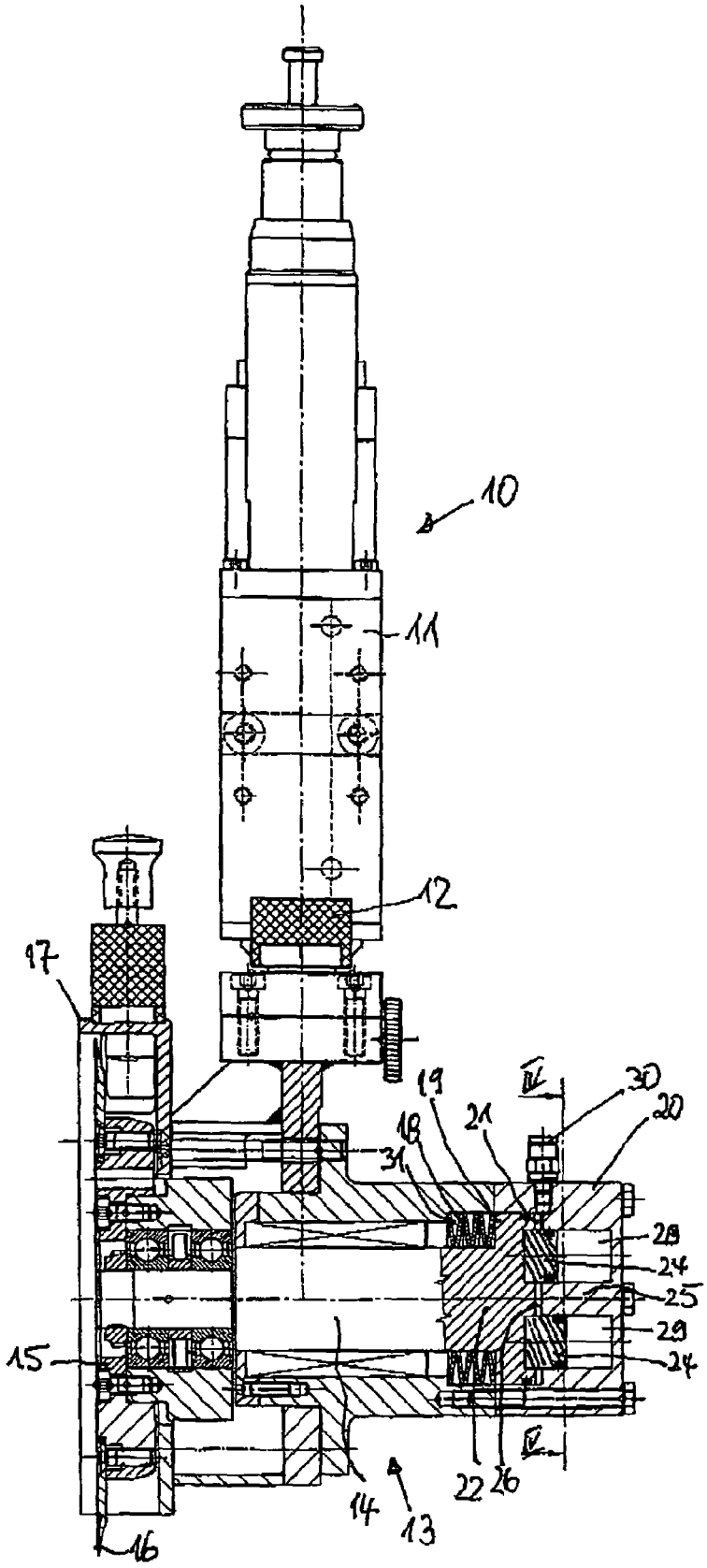
FIG. 3 shows another embodiment of the adjustment mechanism of FIG. 1.
Figure 4:
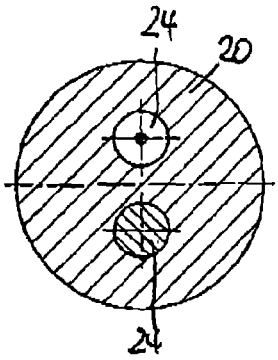
FIG. 4 shows in a cross-sectional view the adjustment mechanism of FIG. 3 taken along the line IV-IV in FIG. 3.

The embodiment illustrated in FIGS. 3 and 4 differs from the previously described embodiment in that two extensions 24 are provided on the adjustment piston 22, each having a different axial dimension. To receive the extensions 24, the portion 21*a* of the chamber 21, which corresponds to the embodiment of FIGS. 1 and 2, is divided by a partition 25 into two partial chambers 28 and 29, whereby a respective extension 24 extends into one of the partial chambers 28 and 29 respectively. The partial chambers 28 and 29 are interconnected via a passage 26 that extends through the partition 25 and that is disposed in such a way that it is covered by the extension 24 that first becomes effective and that has the smaller axial dimension. Only after the movement of the adjustment piston 22 over the piston path prescribed by the axial dimension of the first extension 24 does such first extension 24 in the partial chamber 28 release the passage 26, and the extension 24 disposed in the second partial chamber 29 also comes under the effect of the compressed air that is supplied.

As a consequence, there results on the whole a three-stage manner of operation of the adjustment mechanism, because in the position shown in FIG. 3, initially only the residual piston surface 23 that is reduced by the piston surfaces of the two extensions 24 is effective. After passing through a first adjustment path, the first extension 24 is released from the pertaining partial chamber 28, so that the effective piston surface is increased by the amount of the piston surface that is attributable to the first extension 24, with a first force reinforcement being connected therewith. If after passing through a further adjustment path the passage 26 is released or exposed, and also the second extension 24 has moved out of its pertaining partial chamber 29, the effective piston surface is once again increased by the piston surface attributable to the second extension 24, so that in the illustrated embodiment the entire surface of the adjustment piston 22 is now effective.

Figure 5:
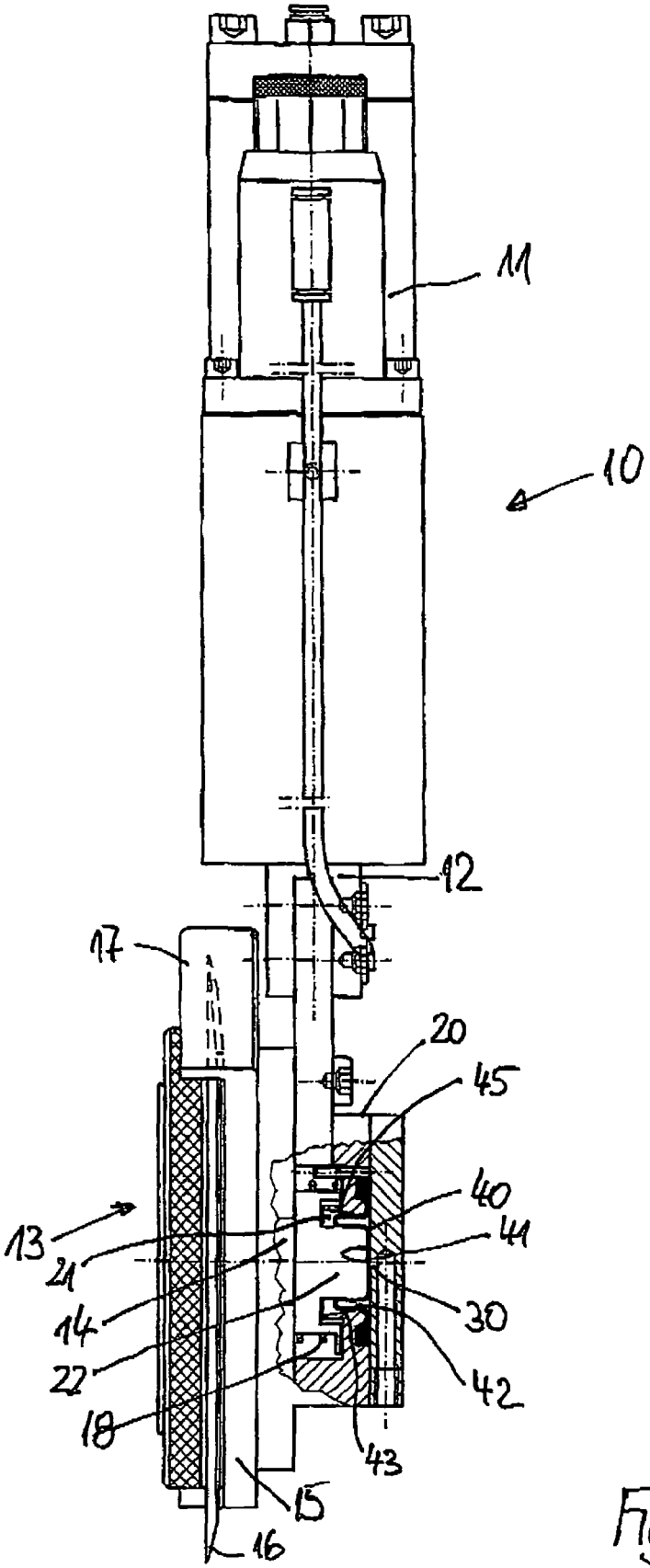
FIG. 5 shows a further embodiment of the adjustment mechanism of FIG. 1.

With the embodiment illustrated in FIG. 5, the arrangement is such that the piston surface of the adjustment piston that is effective in the direction of adjustment is increased in a stepless or continuous manner. In this connection, the blade holder shown in FIG. 5 has the same construction as already described in particular with regard to FIG. 1.

To carry out the adjustment movement, there is again formed in the blade head housing 20 a chamber 21 into which extends the adjustment piston 22 that is connected with the adjustment piston rod 14, accompanied by the formation of an annular space 42 between the adjustment piston 22 and the outer wall 45 of the chamber 21. In this case, the piston surface is formed by a membrane 40 that spans the end face 41 of the adjustment piston 22 and after bridging the annular space 42 is fixed in position at its outer periphery in the blade head housing 20 or with the illustrated embodiment on a separate insert that forms the chamber 21. To enable a movement of the adjustment piston 22 in the chamber 21 with the membrane 40 secured to the piston, a loop 43 of the membrane 40 extends into the annular space 42 in the direction of adjustment in such a way that during the movement of the adjustment piston 22 in the direction of adjustment, in other words toward the left in the illustration of FIG. 5, the membrane 40 rolls off along the outer wall 45 of the chamber 21. To initiate the feed movement of the adjustment piston 22, the compressed air supply 30 is disposed in the region of the end face 41 of the adjustment piston 22, so that in the rest or starting positioned illustrated in FIG. 5, the compressed air introduced via the air connection 30 acts directly upon the end face 41 of the adjustment piston 22 having the membrane 40.

To achieve a continuous increase of the membrane surface that is effective as the piston surface, the outer wall 45 of the chamber 21 has a course that continuously widens conically in the direction of adjustment such that with an increasing path of the adjustment piston in the chamber 21, the membrane 40 rolls off on the widening outer wall 45, thereby resulting in the continuous enlargement of the membrane surface that is effective as the piston surface.

The invention is not limited to the embodiments described in the foregoing figures, rather further stages of the pressure increase can also be achieved by the described measures.

The features of the subject matter of these documents disclosed in the foregoing specification, the patent claims, the abstract and the drawings can be important individually as well as in any combination with one another for realizing the various embodiments of the invention.

The specification incorporates by reference the disclosure of German priority document 102 60 031.7 filed Dec. 19, 2002.

The present invention is, of course, in no way restricted to the specific disclosure of the specification and drawings, but also encompasses any modifications within the scope of the appended claims.

The invention claimed is:

1. A blade holder for a cutting machine, comprising:

a blade head held on a raising and lowering device, wherein said blade head is provided with a circular blade;

an adjustment mechanism for said circular blade, wherein for a movement of said circular blade between a cutting position and a ready position, said adjustment mechanism is provided with an adjustment piston rod having an adjustment piston that is guided in a chamber of a housing of said blade head and that is adapted to be moved by compressed air, and wherein a piston surface of said adjustment piston that is effective in a direction of adjustment has a cross-sectional area that is different in different positions of said adjustment piston such that as a path of said adjustment piston in said direction of adjustment increases, said piston surface that is acted upon by compressed air increases, wherein said adjustment piston is provided with at least one extension, wherein a peripheral surface of the at least one extension slidingly engages an inner, axially extending surface of the housing; and a compression spring for biasing said adjustment piston rod into said ready position of said circular blade.

2. A blade holder according to clam 1, wherein said piston surface of said adjustment piston is increased in a stepped manner.

3. A blade holder according to claim 2, wherein said chamber is provided with a portion that is disposed behind a means for supplying compressed air as viewed in said direction of adjustment of said adjustment piston, wherein said chamber portion has a smaller diameter formed by a step of said chamber, and wherein said at least one extension extends into said chamber portion.

4. A blade holder according to claim 3, wherein said adjustment piston is provided with two extensions that have different axial dimensions and extend into said chamber portion.

5. A blade holder according to claim 2, wherein said at least one extension that, counter to said direction of adjustment, extends axially into a recessed area in a rearward wall of said chamber, and wherein a means for supplying compressed air is disposed in a portion of said wall of said chamber that is disposed beyond said recessed portion.

6. A blade holder according to claim 5, wherein said adjustment piston is provided with two extensions that have different axial dimensions and extend into a chamber portion of said chamber.

7. A blade holder according to claim 6, wherein said chamber portion is divided by a partition into two partial chambers that an interconnected by a passage, and wherein said passage is covered by that extension that is initially effective for an increase of the piston surface, and after a prescribed path of said adjustment piston has been achieved is released such that subsequently the second extension in the further partial chamber is additionally acted upon.

8. A blade holder according to claim 7, wherein a plurality of extensions having associated partial chambers of said chamber are provided on said adjustment piston.

9. A blade holder according to claim 5, wherein said adjustment piston is provided with a plurality of extensions that are tributed over a surface of said piston, are respectively provided with different axial dimensions, and extend into associated recessed areas of said rearward wall of said chamber.

* * * * *